United States Patent [19]

Tobolt

[11] Patent Number: 4,491,238

[45] Date of Patent: Jan. 1, 1985

[54] RECEPTACLE HAVING A PLUG CLOSURE

[76] Inventor: Michael J. Tobolt, 1544 Concord Ct., St. Charles, Ill. 60174

[21] Appl. No.: 560,314

[22] Filed: Dec. 12, 1983

[51] Int. Cl.[3] ..... B65D 39/00

[52] U.S. Cl. ..... 220/307; 220/354; 150/55

[58] Field of Search ..... 220/307, 306, 354, 355; 150/55

[56] References Cited

U.S. PATENT DOCUMENTS

| | | | |
|---|---|---|---|
| 4,334,631 | 6/1982 | Ballester | 220/307 |
| 4,397,404 | 8/1983 | Blanchette | 220/307 |
| 4,452,382 | 6/1984 | Von Holdt | 220/307 |

*Primary Examiner*—George T. Hall

*Attorney, Agent, or Firm*—John L. Schmitt

[57] ABSTRACT

A receptacle particularly adapted for storage and transportation of a liquid comprises a container and a replaceable cover. An upper end of the container is formed with an inner and outer peripheral rim spaced apart to receive an inside and outside peripheral flange of the cover. The cover outside flange has a ring-like offset which snaps into a recess in the container outer rim to hold the cover and container together. Surfaces of the container rims and cover flanges engage to form an inner seal and an outer seal to inhibit leakage of liquid from the receptacle. The cover may be removed by use of a tool which can produce permanent damage to the outer seal. The surfaces of the inner seal remain intact allowing replacement of the cover to reseal the receptacle.

8 Claims, 9 Drawing Figures

RECEPTACLE HAVING A PLUG CLOSURE

BACKGROUND OF THE INVENTION

1. Field of the Invention

This invention relates to receptacles for the containment, storage, and shipment of liquid, for example a finishing material such as paint.

2. Prior Art

The receptacle was perhaps one of man's first innovations. The configeration of particular receptacles varies greatly and depends generally on the nature, size and shape of the matter to be contained. Additionally, the environment to which the matter and receptacle are to be subjected must be considered. Further, any additional function which a receptacle is to provide affects the receptacle form, for example dispersement of the matter from the receptacle.

There are numerous disclosures relating to receptacles. U.S. Pat. No. 2,780,385 discloses a bread holding closure wherein a peripheral flange of a lid fits into a rim groove of a receptacle. An instrument case is set forth in U.S. Pat. No. 3,007,602. The case has a cover with an external bead which snaps into a circular groove of a base. A further closure assembly is shown in U.S. Pat. No. 3,910,448 where a peripheral flange of a top fits into a groove about an open end of a base. The container of U.S. Pat. No. 4,014,450 is particularly adapted for storage of textile threads and yarns of various shapes and sizes.

U.S. Pat. No. 4,210,258 discloses a plastic receptacle for paint. A bucket portion of the receptacle has an inwardly offset peripheral upper lip formed with an outwardly facing horizontal recess. A lid portion of the receptacle in turn has an inverted U-shaped rim defining an annular groove. The rim further includes an inwardly facing annular flange. The bucket lip fits into the lid groove with the lid flange fitting into the bucket lip recess. A specimen collection assembly receptacle is shown in U.S. Pat. No. 4,244,920 wherein a cap may be threaded onto a cup. The cap has three, spaced apart, circular flange members which are positioned to mate with a rim portion of the cup and a protective lip portion of a detachable handle assembly.

SUMMARY OF THE INVENTION

A receptacle of this invention is particularly adapted for containing a liquid such as paint. The receptacle includes a container and a cover which may be attached to the container, subsequently removed and then reassembled to the container to reseal the liquid therein. The container and cover preferably are made of a semi-rigid thermoplastic material. The container has a generally cylindrically shaped body with a closed bottom and open top. The container top includes an inner and outer peripheral rim which are spaced apart to form a circular groove. At a bottom of the groove in the outer rim is a horizontal recess having a horizontal ledge.

The cover is so dimensioned to close the container open end and has an inside and outside downwardly depending peripheral flange. The flanges are spaced apart to define an annular slot. At a bottom of the outside flange on an outside surface of such is a ring-like offset having a horizontal edge.

To attach the cover to the container, the cover slot is aligned with the container inner rim. This alignment allows the cover to be lowered to engage the container with the cover outside flange sliding into the container groove. As the cover slot bottoms on the container inner rim top edge, the cover flange offset snaps into the container rim recess. The horizontal edge of the cover flange seats under the container recess horizontal ledge to inhibit upward cover movement.

Assembly of the cover to the container forms an inner and outer seal therebetween. The inner seal is provided for the most part by engagement of the inner and outer surfaces of the container inner rim with the outside and inside surface of the inside and outside cover flange respectively. The inner seal has a generally hairpin-like cross sectional configeration. The outer seal is formed by engagement between an inner surface of the container outer rim, and vertical side and horizontal ledge of the rim recess with the outside surface of the cover outside flange and vertical side and horizontal edge of the flange offset respectively. These surfaces of the inner and outer seal engage over an extensive area thus requiring only a minimum of force to hold such in sealed contact. This sealing force is provided by a series of intermittently spaced gussets connecting a top wall of the cover with the cover inside flange and acts in a direction normal to the surfaces in contact.

The receptacle of this invention has several advantages over other known receptacles.

First, the container may be filled with a liquid such as paint, sealed by attaching the cover, and then the receptacle shipped to remote locations for ultimate distribution and use by consumers. During periods of shipment and storage the double seal provided between the container and cover insures that there is no leakage of liquid. Additionally, the liquid is isolated from the environment about the container which could contaminate the liquid. The high quality of these seals is insured by contact between extensive surface areas of the container rims with the cover flanges. These extensive areas of engaging surfaces result in part from the configeration of the surfaces which is substantially cylindrical. The seals are produced by area contact as opposed to line or point contact. Because the area of contact between these surfaces is substancial, the magnitude of the force required to insure that this contact is continuous may be quite low. This force is further minimized by having it act in a direction normal to the sealing surface.

The second important advantage provided by this receptacle is the ease with which the cover may be removed from the container without the need for a special tool. A readily available tool, for example a screw driver may be used to disengage the cover offset edge from the container recess ledge allowing removal of the cover. The overlap between the cover edge and container ledge is sufficient to hold the cover in place but not so extensive as to unduly inhibit cover removal.

A further important advantage of this receptacle is that after the cover is initially removed, the cover may be reassembled to the container to reseal the receptacle. With most sealed recpetacles, if the cover is not carefully removed, the surfaces forming the seal between the cover and container are damaged. Note that the inner seal between the cover and container of this innovative receptacle remains intact even if the surfaces of the outer seal are damaged by the tool used to pry off the cover. Thus the receptacle is resealable even if treated abusively.

DESCRIPTION OF THE PREFERRED EMBODIMENT

Figure 1:
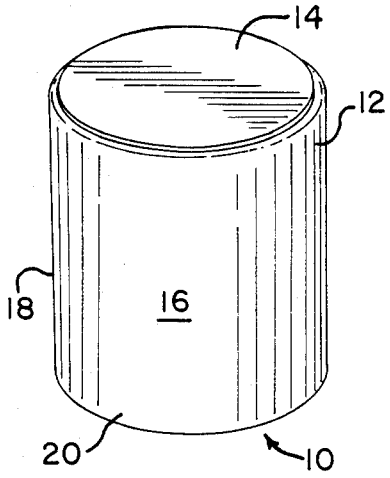
FIG. 1 is a perspective view of a receptacle.
Figure 2:
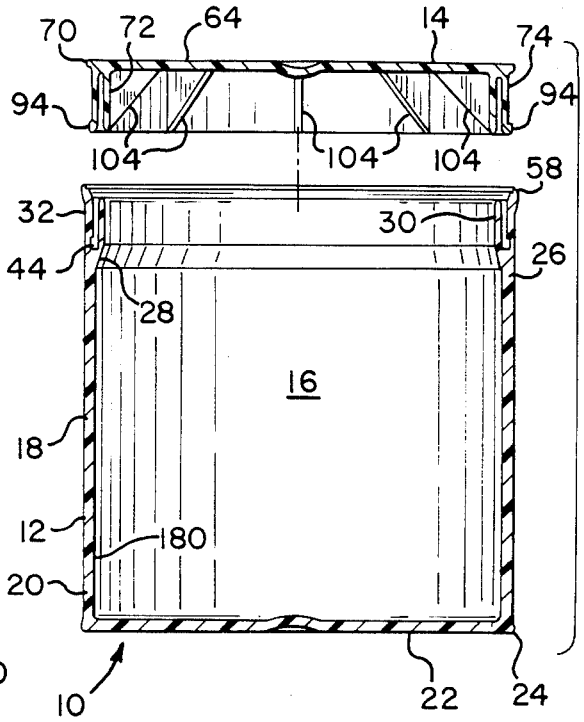
FIG. 2 is a cross section elevation view of the receptacle of FIG. 1.
Figure 4:
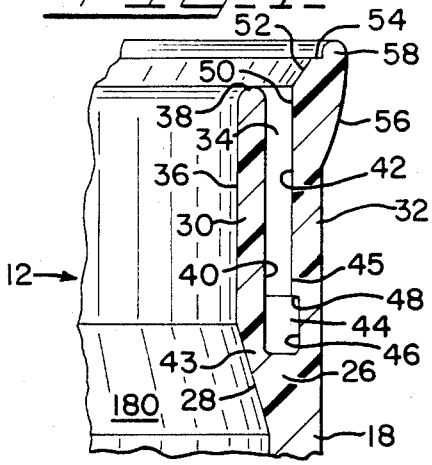
FIG. 4 is a partial detailed view in section of a container of the receptacle of FIG. 2.

A receptacle 10 of this invention is shown generally in FIGS. 1 and 2 includes a container 12 and an attachable cover 14. The container 12, shown in FIGS. 2, 4, and 5, has a hollow cylindrical shaped body 16 formed by a sidewall 18 closed at its lower end 20 by a bottom 22. The bottom 22 may include a peripheral bead 24. An upper end of the sidewall 18 joins an intermediate sidewall portion 26 having an upwardly converging inner tapered surface 28.

The sidewall intermediate portion 26 connects with an inner and outer rim 30, 32 which the spaced apart by a circular groove. 34. An inner groove 36 of the inner rim 30 connects with the inner surface 28 of the sidewall intermediate portion 26. The inner rim 30 has a rounded top edge 38 which in turn connects the rim inner surface 36 to an outer surface 40 of the inner rim 30. An inner surface 42 of the outer rim 32 and the inner rim outer surface 40 define in part the circular groove 34. Between the outer surface 40 of the inner rim 30 and the inner tapered surface 28 of the intermediate sidewall portion 26 is thinned wall section 43.

At a lower end 45 of the outer rim inner surface 42 is a recess 44 defined by a vertical wall 46 which is connected to the outer rim surface 42 to a narrow, annular horizontal ledge 48. An upper end 50 of the outer rim surface 42 connects with an annular beveled shelf 52 having a horizontal lip 54. Connecting the shelf lip 54 to an outer surface 56 of the outer rim 32 is a top peripheral bead 58.

Figure 3:
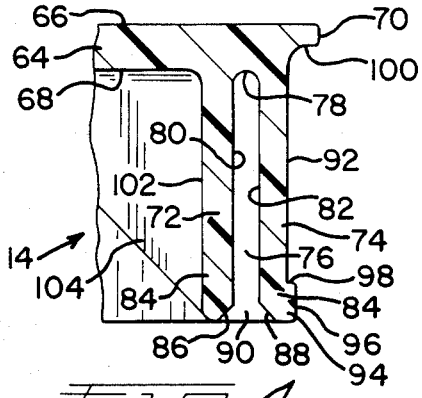
FIG. 3 is a partial detailed view in section of a cover of the receptacle of FIG. 2.
Figure 5:
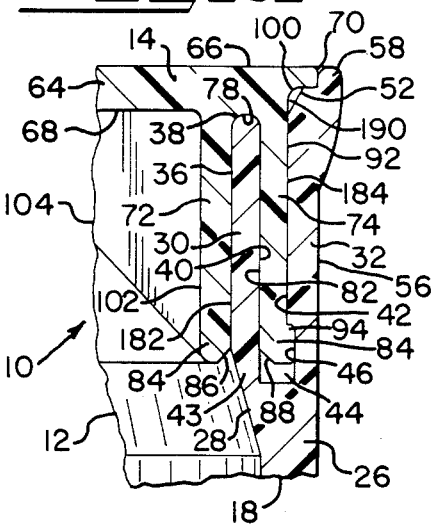
FIG. 5 shows the cover and container of FIGS. 3 and 4 assembled.

The cover 14 of the receptacle 10 is best understood by viewing FIGS. 2,3 and 5. The cover 14 includes a top wall 64 having a substantially flat top and bottom surface 66,68. The top wall 64 terminates at a circular outer edge 70.

Connecting with the bottom surface 68 of the cover top wall 64 are an inside and outside flange 72,74. The flanges 72,74 are spaced apart to form a downward facing circular slot 76 having a radiused roof surface 78. The roof surface 78 connects an outside surface 80 of the inside flange 78 to an inside surface 82 of the outside flange 74. At a lower end 84 of each flange 72,74 the outside surface 80 of the inside flange 72 and the inside surface 82 of the outside flange 74 is an inside and outside chamfered segment 86,88. These segments 86,88 form an enlarged opening 90 to the cover slot 76.

On an outside surface 92 of the cover outside flange lower end 84 is an offset 94. The offset 94 has a vertical wall 96 which is connected to the outside flange outside surface 92 by a narrow, annular horizontal edge 98. The outside flange 74 is set inwardly from the top wall outer edge 70 so that a radiused segment 100 connects the outer edge 70 to the outside flange outside surface 92.

Connecting an inside surface 102 of the cover inside flange 72 to the bottom surface 68 of the cover top wall 64 are a series of triangular shaped gussets 104. The gussets 104 may be equispaced, for example at 45 degree intervals so that the cover 14 has a total of 8 gussets 104.

Figure 6:
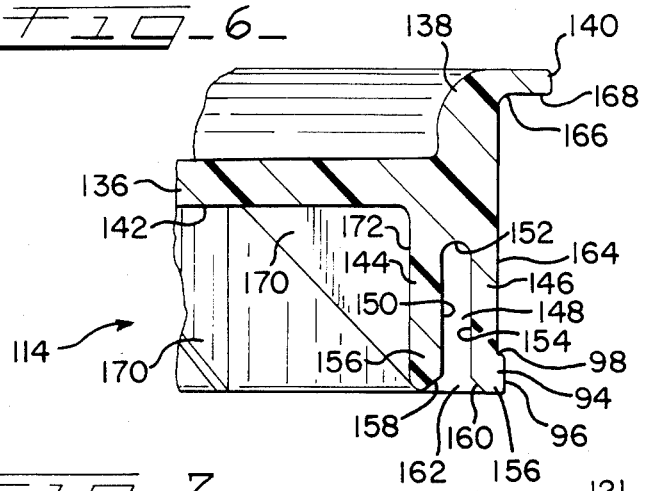
FIG. 6 is a partial detailed view in section of another embodiment of a cover of this inventive receptacle.
Figure 7:
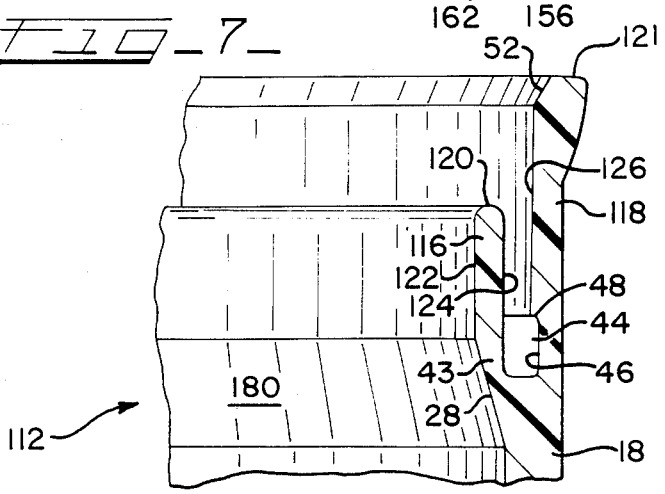
FIG. 7 is a partial detailed view in section of a container for use with the cover of FIG. 6.
Figure 8:
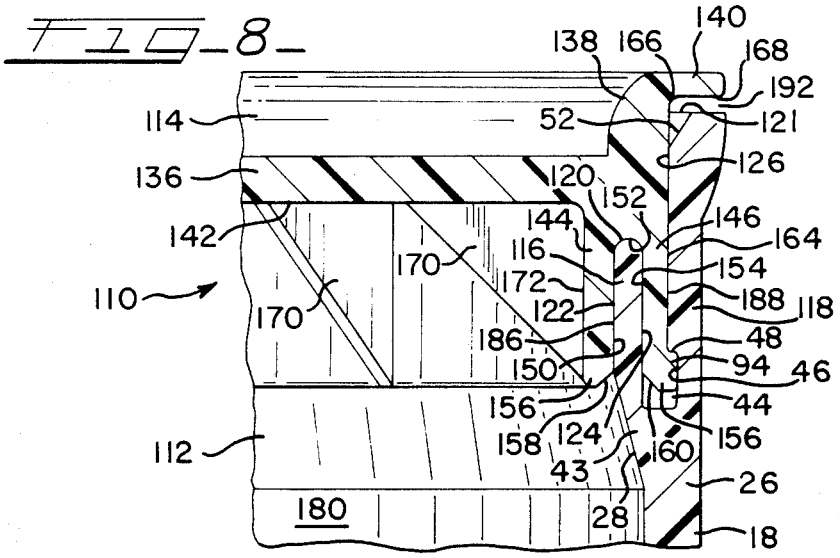
FIG. 8 shows the cover and container of FIGS. 6 and 7 assembled.

In FIGS. 6-8 a further receptacle 110 is shown and comprises a container 112 and an attachable cover 114. The receptacles 10,110 are alike in many respects and like reference numbers are used to identify similar structure.

Connecting with the intermediate portion 26 of the container 112 are an inner and outer rim 116,118. A rounded top edge 120 of the inner rim 116 is positioned below a flat horizontal lip 121 forming the top of the outer rim 118.

The top edge 120 of the inner rim 116 connects an inner and outer surface 122,124 of the inner rim 116. Like the inner rim 30 of the container 12 the inner rim 116 of the container 112 has a thinned wall section 43. Like the outer rim 32 of container 12, the container outer rim 118 is formed with the recess 44. This recess 44 likewise has a vertical wall 46 and ledge 48 which connects with an inner surface 126 of the outer rim 116. The outer rim inner surface 126 and the top lip 121 are connected by a like beveled shelf 52.

The cover 114 which may be fitted to the container 112 has a substantially flat center portion 136 joined by a raised peripheral edge 138. Extending outwardly from the peripheral edge 138 is an outer ring portion 140. Projecting below a bottom surface 142 of the cover center portion 136 and connecting with the peripheral edge 138 are an inside and outside flange 144, 146. The inside and outside flanges 144,146 are spaced apart to form a circular slot 148 therebetween which is defined by an outside surface 150 of the inside flange 144, a radiused roof surface 152, and an inside surface 154 of the outside flange 146. At a lower end 156 of each flange 144, 146 the respective outside and inside surface 150,154 of such includes a chamfered segment 158,160. Similar to the cover 14, these chamfered segments 158, 160 define an enlarged opening 162 to the circular slot 148.

At the lower end 156 of the outside flange 146 on an outside surface 164 of such is a further offset 94 similarly defined by vertical wall 96 and narrow, annular horizontal edge 98. The edge 98 connects the offset vertical wall 96 to the outside flange outside surface 164. This surface 164 extends upward to connect with a radiused segment 166 which in turn joins a lower side 168 of the raised peripheral edge outer ring 140.

Like the cover 14, the cover 114 includes a series of triangular shaped gussets 170 attached to the cover center portion bottom side 142 and to an inside surface 172 of the inside flange 144. The gussets 170 may be spaced intermittently about the cover 114, for example also on 45 degree increments.

As was briefly discussed earlier, the containers 12, 112 and cover 14, 114 of the receptacles 10, 110 are preferably made of a semirigid thermoplastic material such as polyethlene or polypropylene. High production rate, injection molding techniques can be used to fabricate the receptacles 10, 110. For example, to make the container 12, uncured plastic material is forced under high pressure and temperature into a cavity formed between an interior mold surface and an exterior core surface. The exterior core surface is complementary to an interior surface 180 of the container 12. It is most desirable that this interior surface 180 be uninterupted or seamless which may be readily produced by using a one-piece core. If the exterior surface of the core were made by joining two or more core portions, a seam in the surface 180 could be formed at a joinder of these core portions.

When containers 12, 112 are made using a one-piece core, the core is withdrawn from each container 12, 112 after the containers 12, 112 are removed from the mold. While not critical to core withdrawal the thinned wall section 43 allows the inner rim 30, 116 of each container 12, 112 to be flexed outward. Additionally, the semi-rigid nature of the plastic material provides for some expansion of the container sidewall intermediate portion 26 without producing a permanent set. Thus, the inner rim inner surfaces 36, 122 of the containers 12, 112 remains smooth and undamaged during core withdrawal.

Once a container has been filled with liquid, a cover typically is assembled to it. In the following discussion reference is made only to the receptacle 10, container 12 and cover 14. Unless otherwise noted, this discussion also is applicable to the receptacle 110, container 112, and cover 114.

To assemble the cover 14 to the container 12 the cover slot 76 is aligned with the container inner rim 30. The cover 14 is then lowered until the lower end 84 of the outside flange 74 engages the beveled shelf 52 of the container 12. As the cover 12 is lowered further, the beveled shelf 52 deflects the outside flange 74 inward into the container groove 34. Concurrently the outside flange 74 deflects the container inner rim 30 inward. This inward deflection of the container inner rim 30 by the cover outside flange 74 is not sufficient to avoid the enlarged opening 90 of the cover slot 76. Thus, the container inner rim 30 is guided into the cover slot 76 by the flange chamfered segments 86, 88. As the top edge 38 of the container inner rim 30 contacts the radiused roof surface 78 of the cover 14, the cover offset 94 snaps into the container recess 44 so that the offset edge 98 locks under the recess ledge 48. This interference fit between the container recess ledge 48 and cover offset edge 98 impedes any upward movement of the cover 14. In FIGS. 5 and 8 the covers 14, 114 are shown assembled to the containers 12, 112 respectively to form sealed receptacles 10, 110.

Note that the receptacle 10 may best be used for a liquid which is not particularly affected by an atmosphere being trapped between a top surface of the liquid and cover 14. Where the presence of air, for example, could be detrimental to the contained liquid, receptacle 110 is preferred because the cover center portion 136 is recessed to reduce volume of entrapped atmosphere.

Figure 9:
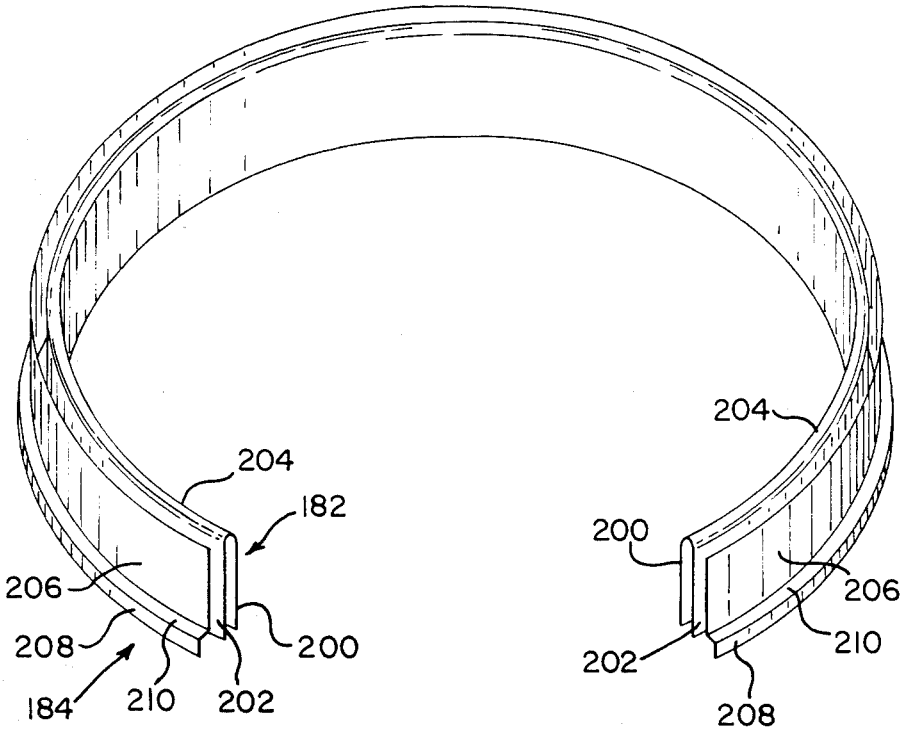
FIG. 9 is a perspective view of a typical inner and outer seal formed between the cover and container of this inventive receptacle.

With the cover 14, 114 assembled to the container 12, 112, the receptacle 10, 110 may be prepared for shipment to a commercial outlet where it then may be stored before ultimate use of the contained liquid. During such shipment and periods of storage an inner seal 182, 186 and outer seal 184, 188 between the container 12, 112 and cover 14, 114 respectively prevent leakage of liquid from the respective receptacle 10, 110 and protect the contained liquid from the environment external of each receptacle 10, 110. The configuration of the inner and outer seals 182, 184 of the receptacle 10 is shown in FIG. 9. The configuration of the seals 186, 188 of the receptacle 110 is quite similar.

The inner seal 182 of the receptacle 10 is provided by engagement of the inner and outer surfaces 36, 40 and top edge 38 of the container inner rim 30 with the cover inside flange outside surface 80, radiused roof surface 78, and outside flange inside surface 82. The outer seal 184 is provided by engagement of the container outer flange inner surface 42 and recess ledge 48 and vertical wall 46 with the cover outside flange outside surface 92 and offset edge 98 and vertical wall 96.

The inner seal 182 has a hairpin-like cross sectional configeration wherein smaller and larger diameter cylindrical rings 200, 204 are concentrically and vertically aligned and then joined by an upper radiused segment 204. The outer seal 184 has a stepped cross sectional configuration wherein smaller and larger diameter cylindrical rings 206, 208 are concentrically aligned and vertically offset and joined by a horizontal segment 210 at the offset.

The inner seal 182 and the outer seal 184 each have a substantial seal area produced by placing in contact the various surfaces noted above. Sealing contact between these surfaces is maintained by the gussets 104 which apply a slight outward force to these surfaces in a direction which is substantially normal to these surfaces.

Note that the inner and outer seal 186, 188 of the receptacle 110 are produced by engagement of the surfaces of the container inner and outer rims 116, 118 with the cover inside and outside flanges 144, 146 respectively.

To gain access to the contained liquid, the cover 14, 114 must be removed from the container 12, 112. To remove the cover 14, 114 an end of a tool, for example a screw driver, may be used. As seen in FIG. 5, a space 190 is formed between the container beveled shelf 52 and the cover radiused segment 100. This space 190 allows a screw driver tip to be inserted first between the container top peripheral bead 58 and the cover outer edge 70. The screw driver tip next may be positioned between the container outer rim inner surface 42 and cover outside flange outside surface 92. This insertion disengages the cover offset edge 98 from the container recess ledge 48 allowing the cover 14 to be pried upward for subsequent disassembly.

Receptacle 110 has a similar space 192, see FIG. 8. This space 192 is formed between the radiused segment 166 and the lower side 168 of the outer ring 140 of the cover 114 and the beveled shelf 52 and top lip 121 of the container 112. Likewise, a tool may be inserted into the space 192 and then between the surfaces 126, 164 to release the cover offset edge 98 from the container recess ledge 48.

Any damage by the insertion of this tool to the outer seal 184, 188 of the respective receptace 10, 110 does not affect the integrity of the inner seal 182, 186 of such. Thus, the cover 14, 114 may be reassembled to the container 12, 112 to reseal the receptacle 10, 110.

While embodiments of this invention have been shown and described, it should be understood that the invention is not limited hereto except by the scope of the claims. Various modifications and changes can be made without departing from the scope and spirit of the invention as the same will be understood by those skilled in the art.

What I claim is:

1. A receptacle including a container for holding a liquid and a cover fittable to an open end of said container to inhibit leakage of said liquid from said receptacle regardless of an orientation thereof, said receptacle comprising:

an inner seal between said container and said cover formed by engagement of a pair of parallel inner and outer surfaces of a circular inner rim of said container with an inside and outside surface of an inside and outside flange of said cover respectively, said surfaces proximately aligned with a longitudinal axis of said receptacle, and by engagement of a top edge of said container inner rim with a roof of a slot of said cover, an outer seal between said container and said cover formed by engagement of an inner surface of a circular outer rim of said container with an outside surface of said outside flange of said cover and by a wall and a ledge of a recess in said container outer rim with a wall and an edge of an offset on said cover outside flange, said surfaces and said walls proximately aligned with said receptacle longitudinal axis, and gusset means attached to a top wall of said cover and an inside surface of said cover inside flange to produce forces normal to said receptacle longitudinal axis to maintain said aligned surfaces in continuous sealing engagement, wherein said receptacle may hold said liquid in a leak proof manner during storage and movement, said cover being readily removable from said container to provide access to said liquid with said cover being readily reassemable to said container so that unused liquid may be further stored in a leak proof manner.

2. A receptacle including a container particularly adapted for holding liquid and a cover assemblable to, removal from and reassembable to said container to seal, unseal, and reseal said receptacle respectively, an improvement of said receptacle comprising:

an inner seal between said container and said cover, said inner seal formed by engagement of inner rim surfaces of said container with inside and outside flange surfaces of said cover, said engagement defining a larger and a smaller diameter cylindrical ring, said rings concentrically and longitudinally aligned and joined at one end by radiused segment, and an outer seal between said container and said cover, said outer seal formed by engagement of an inner surface of said container outer rim and a ledge and a wall of a recess in said outer rim with an outside surface of said cover outside flange and an edge and a wall of an offset on said cover outside flange, said engagement defining a further larger and smaller diameter cylindrical ring, said further rings concentrically aligned and longitudinally offset and joined by a segment positioned normal to said rings at said offset.

3. A receptacle made of a semirigid plastic material comprising:

a container having a cylindrically shaped sidewall with one end enclosed by a bottom and an opposite open end to provide access to an interior of said container, said open end defined in part by an inner and outer rim spaced apart to form a circular groove therebetween with said outer rim having a recess formed in part by a wall and a ledge connecting said wall to an inner surface of said outer flange, and a cover having a top wall with an inside and outside flange joined thereto, said flanges spaced apart to form a circular slot therebetween with said outside flange having an offset formed in part by a wall and an edge connecting said wall to an outside surface of said outside flange, and gussets intermittently spaced about said cover and connecting said cover top wall to an inside surface of said inside flange, wherein said cover may be assembled to said container by aligning said cover slot with said container inner rim and lowering said cover to slide said cover outside flange into said container groove with said cover offset snapping into said container recess to inhibit disassembly of said cover from said container, said container and said cover forming an inner and outer seal between surfaces of said container rims and said cover flanges to make said receptacle leak proof with said gussets providing minimal sealing forces on said surface with areas of said surfaces in contact being substantial.

4. A receptacle as defined by claim 3 and further characterized by, said cover inside and outside flange each having a chamfered segment to form an enlarged opening to said cover slot.

5. A receptacle as defined by claim 3 and further characterized by, said container outer rim having an upper beveled shelf to guide said cover outside flange into said container groover during assembly of said cover to said container.

6. A receptacle as defined by claim 5 and further characterized by, said container beveled shelf and said cover defining therebetween a space for a tool to aid in removing said cover from said container.

7. A receptacle as defined by claim 3 and further characterized by, an interior surface of said container being seamless with said container inner flange having a thinned wall section to facilitate providing said seamless interior.

8. A receptacle as defined by claim 3 and further characterized by, said cover having a raised peripheral edge with a center portion of said cover defined in part by said top wall positioned from said edge, and said container inner flange having a top edge longitudinally offset from a top edge of said container outer flange, wherein upon assembly of said cover to said container an inner volume of said receptacle is reduced.

* * * * *